United States Patent [19]

Ennis

[11] 4,130,962

[45] Dec. 26, 1978

[54] SUPERIOR PERFORMANCE YO-YO

[75] Inventor: Thomas H. Ennis, Chamblee, Ga.

[73] Assignee: Jack Russell Company, Inc., Key Biscayne, Fla.

[21] Appl. No.: 706,753

[22] Filed: Jul. 19, 1976

Related U.S. Application Data

[63] Continuation of Ser. No. 522,333, Nov. 11, 1974, abandoned.

[51] Int. Cl.[2] ..... A63H 27/12

[52] U.S. Cl. ..... 46/61

[58] Field of Search ..... 46/60–64, 46/50

[56] References Cited

U.S. PATENT DOCUMENTS

| | | | |
|---|---|---|---|
| 1,419,402 | 6/1922 | Mosher | 46/61 |
| 2,538,120 | 1/1951 | Nakano | 46/61 |
| 2,623,327 | 12/1952 | Testino | 46/61 X |
| 2,645,881 | 7/1953 | Frangos | 46/63 |
| 2,676,432 | 4/1954 | Field | 46/61 |
| 3,184,885 | 5/1965 | Gibson | 46/61 |
| 3,444,644 | 5/1969 | Sayegh | 46/61 |

*Primary Examiner*—F. Barry Shay

*Attorney, Agent, or Firm*—Newton, Hopkins & Ormsby

[57] ABSTRACT

A Yo-Yo formed of an axle and a pair of complimentary body segments, disposed in opposed relationship on the axle. Each body segment includes an inner and outer plastic shell having at their peripheries, concentric spaced annular rings which intermesh with each other. The inner shells have holes through which the axle projects. The outer shells each include a central hub with a metal sleeve which receives the end portion of the axle. The weight of the Yo-Yo is disposed essentially in the periphery of the segments by means of the intermeshing annular rings on the shells. A string encompasses an annular groove in the central portion of the axle. Adjacent the central groove, the abutting faces of the inner shells are provided with circumferentially disposed protuberances which snare the string. The opposed surfaces of each segment is parallel to each other, in their central positions and then diverge conically from each other and provide a curve angle relationship between the string and the faces of the body segments which will afford less likelihood of precession when the string engages the body segment.

12 Claims, 2 Drawing Figures

SUPERIOR PERFORMANCE YO-YO

CROSS REFERENCE TO RELATED APPLICATIONS

This is a continuation of application Ser. No. 522,333 filed Nov. 11, 1974, now abandoned.

BACKGROUND OF THE INVENTION

This invention relates to Yo-Yos and is more particularly concerned with a loose string Yo-Yo having spinning characteristics which will enable the Yo-Yo to spin for an extended periof of time.

DESCRIPTION OF THE PRIOR ART

In the past, it has been determined that a Yo-Yo should weigh between approximately 55 grams and 60 grams in order that it be of optimum weight for manipulation from a string. Generally speaking, however, no appreciable attention has been paid to the distribution of the weight so as to prolong the spin of the Yo-Yo and thereby enable the user to perform numerous tricks which, otherwise would not be as successful because of this limited spin time. The present invention, by distributing a substantial part of the weight toward the periphery of the body segments, enables the user to impart more energy to the spinning body portions and store this energy for subsequent dissipation as the Yo-Yo spins at the end of the string.

The conventional Yo-Yo has been made of two body segments joined by an axle, each body segment including a pair of body elements or shells which join together to define a hollow interior. The outer shell of each body segment usually contains, adjacent its periphery, a thickened part which will attempt to produce a flywheel effect.

Since the thickest part of a plastic shell determines the cooling time for the plastic after injection and this is directly related to the rate of production, the amount of weight placed at the periphery has been limited. The present invention through the provision of the plurality of intermeshing rings, sandwiched between each other, has eliminated the necessity for increasing the thickness of any one part of the Yo-Yo to produce this flywheel effect, and has reduced the cooling time by providing shells, the cross-sections of which are approximately uniform.

In the past, it has generally been thought that Yo-Yos required a relatively large diameter axle so that the axle may be received in the plastic parts and held by friction in place. If the diameter of the axle were reduced appreciably, it would improve the spinning time by reducing friction; however, no way of retaining the axle in the plastic body segment was available. The present invention overcomes this difficulty by providing a boss, or sleeve of metal, embedded in each body segment and receiving an axle end portion.

BRIEF DESCRIPTION OF THE INVENTION

Briefly described, the present invention includes a Yo-Yo provided with an axle and a pair of body segments. Each body segment is constructed of a pair of body elements or shells capable of being injection molded. The inner body element or shell has an outwardly axially protruding, tapered peripheral ring, protruding from the disc shaped body of the inner shell. The outer shell includes a dish shaped body which has a plurality of the inwardly axially extending, tapered, spaced, concentric rings which sandwich therebetween the ring of the inner shell. The intermeshing or sandwiching of these rings provides a heavy periphery to enable the flywheel effect to be achieved by the Yo-Yo while, at the same time, providing relatively thin generally uniform thickness plastic areas for each shell which lends themselves to rapid and uniform cooling.

The central portions of the outer shells of the Yo-Yo consist of inwardly opening concentric metal sleeves carried by hubs secured by their outer ends portions to the inner surfaces of the outer shell. The splined end portions of the axle are received in the bosses or sleeves. The inner surface of the inner shells are provided with a plurality of protuberances, surrounding the central holes through which the axle project. These protuberances are disposed circumferentially around the axle and will function to snare the slackened strand or strands of the string of the Yo-Yo.

Prior art Yo-Yos, generally speaking, have included smooth, flat, parallel inner abutting surfaces for the two opposed body segments. The axle has spaced these inner surfaces apart sufficiently to enable the string to be passed therebetween and around the axle, in the usual way. With this narrow gap, any binding of the string, against one side or the other, has caused the Yo-Yo to precess and go into a flat spin, thereby ruining the trick intended to be performed. The present invention tends to overcome this disadvantage by providing body segments in which the inner surfaces, adjacent the axle, are flat but taper conically outwardly in the peripheral portions thereby providing a progressively widening string receiving area toward the periphery of the Yo-Yo.

These prior art Yo-Yos have been provided with radially extending lands and grooves on the inner surfaces adjacent the axle which are for the purpose of engaging any slack string so that the string will then be gathered about the axle as the Yo-Yo rolls up. The present invention substitutes for these radially extending lands and grooves a plurality of cone shaped protuberances, spaces circumferentially around the axle and extending from the inner surfaces of the opposed inner faces of the body segments. Each protuberance is capable of engaging the strand of the Yo-Yo string so as to snare the same to cause the string to wrap around the axle and cause a return of the Yo-Yo to the manipulator.

Accordingly, it is an object of the present invention to provide a Yo-Yo which is inexpensive to manufacture, durable in structure and efficient in operation.

Another object of the present invention is to provide a Yo-Yo which has superior long spin characteristics.

Another object of the invention is to provide a Yo-Yo having body segments which can readily and easily be injection molded and readily and easily assembled.

Another object of the present invention is to provide in a Yo-Yo an improved manner of joining the body segments of the Yo-Yo to the axle.

Another object of the present invention is to provide a Yo-Yo which is more readily utilized by a novice and which will not readily or easily precess in the event that the Yo-Yo is thrown in an incorrect manner.

Another object of the present invention is to provide a Yo-Yo which, when the string is slack and the body of the Yo-Yo is spinning, will more readily and easily wind upon the string.

Other objects, features and advantages of the present invention will become apparent from the following description when taken in conjunction with the accompanying drawings wherein like characters of reference designate corresponding parts throughout the several views.

DETAILED DESCRIPTION OF THE DRAWINGS

Figure 1:
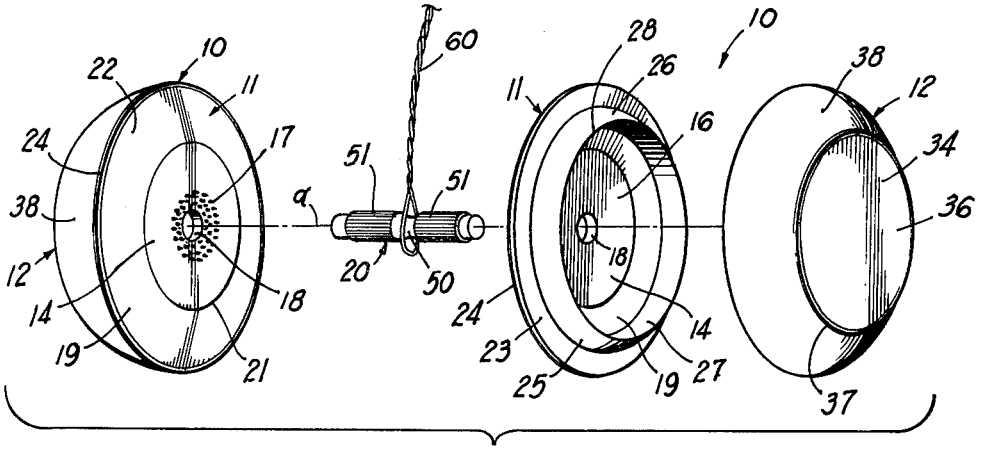
FIG. 1 is an exploded perspective view of a Yo-Yo constructed in accordance with the present invention.

Referring now in detail to the embodiment chosen for the purpose of illustrating the present invention, numeral 10 denotes the two opposed body segments of the symmetrical Yo-Yo of the present invention, joined together by a central axle 20. Each of the body segments 10 is identical and includes an inner body element or shell 11 and an outer body element or shell 12, joined together to define a hollow interior 13.

Each inner body element or shell 11 includes a flat, central disc shaped body or wall 14 having parallel inner and outer surfaces or faces 15 and 16. The inner surface 15 is essentially flat, except that it is provided with a plurality of circumferentially disposed, spaced inwardly extending, protuberances 17, each of which is cone-shaped with a rounded end. These protuberances 17 surround the central hole 18 in wall 14. Integrally joined, by its inner periphery, to the outer periphery 21 of wall 14 is an annular flange 19 provided with inwardly tapering inner and outer surfaces 22 and 23. The inner surface 22 thus provides a conical or peripheral bevel for wall 14 which intersects the flat plane of the inner surface 15.

The outer periphery 24 of the flange 19 (which also is the outer periphery of shell 11) is curved convexly, the curvature merging into inner surface 22 and terminating tangentially at the outer surface 23. Spaced radially inwardly from outer periphery 24 but adjacent thereto is an outer cylindrical or annular ring 25 which protrudes axially outwardly from the surface 23. This ring 25 tapers axially outwardly and is for the purpose of providing a flywheel weight effect for the Yo-Yo. The outer periphery 26 of ring 25 is convexed in cross-section, being of progressively smaller diameter as it projects radially outwardly. The inner periphery 27 is essentially flat, in cross section but is of progressively slightly increasing diameter as it projects axially outwardly, the two peripheries joining at a circular outer edge 28.

Each outer element or shell 12, which forms the outer surface area of the Yo-Yo, is a circular dish-shaped member of approximately the same diameter as the diameter of the inner shell 11. Shell 12 includes a central cylindrical hub 30 which has a central straight cylindrical bore 31. A straight, hollow cylindrical aluminum or metal sleeve, boss or bushing 32 having a central bore 33, is press fitted into the bore 31 of hub 30.

The inner ends of both the sleeve 32 and the hub 30 terminate in a common radial plane. The outer end of hub 30 is integrally carried by the central portion of shell 12, i.e., the central disc-shaped wall 34 of shell 12, and protrudes inwardly from the inner surface 35, thereof, to about the surface 16 of inner shell 11, the bore 33 being aligned with hole 18.

Sleeve 32 may be knurled or provided with axially extending splines (not shown) along its outer periphery, if desired. Sleeve 32 is press fitted and frictionally held by hub 30. Glue may be employed to improve this bond, if desired. The outer end of sleeve 32 abuts surface 35.

The flat disc-shaped wall or body 34 of shell 12 has a flat outer surface 36 which is parallel to its inner surface 35. The periphery 37 of wall 34 integrally merges with an inwardly curved outer peripheral or annular flange 38. The outer surface 39 of flange 38 is convexed, the flange 38 having an inner face or edge 40 which abuts the peripheral portion of wall 23, outwardly of ring 25. Thus, the contour of the outer surface 39 merges into the contour of periphery 24.

The inner surface of flange 38 adjacent edge 39 forms an annular ring which is disposed outwardly of and is concaved along its inner surface to conform to the shape of both the outer surface 26 of ring 25 and surface 40 and provide a flange 38 having about the same thickness as, but slightly greater than, the wall 34.

Spaced inwardly of the flange 38 is an annular ring 40 which projects axially inwardly from the inner surface of flange 38, inwardly adjacent the periphery 27 of wall 34 and terminates at wall 23. The outer surface of ring 41 is of progressively smaller diameter, tapering to the surface of periphery 27, the ring 41 and the flange 38 defining a V-shaped tapered annular groove, therebetween, for receiving the ring 25. The thickness of ring 25 is preferably slightly greater than the V-shaped groove defined by flange 38 and ring 41, namely about 0.005 inches. Thus, the ring 25 can be press fitted into the groove and clamped in place due to the deformation of the parts to accommodate each other, One ring 25 is press fitted into the groove, it is quite firmly held.

Figure 2:
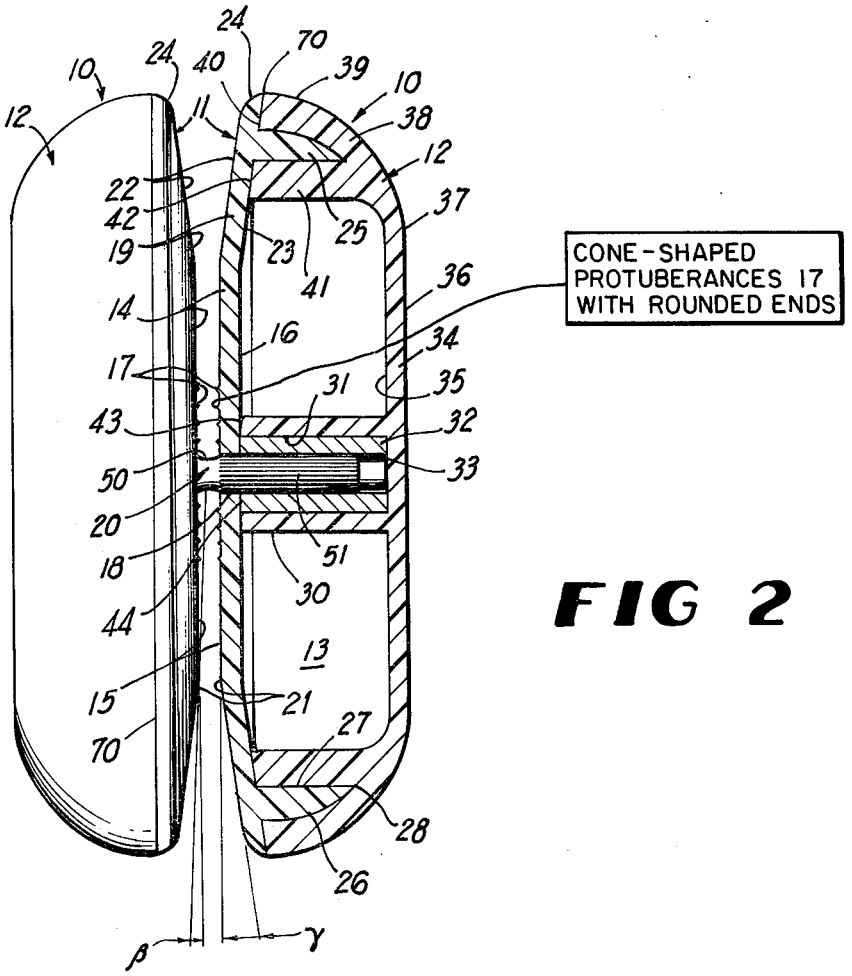
FIG. 2 is a side elevational view partially broken away of the Yo-Yo depicted in FIG. 1.

The dimensions of the inner and outer shell 11 and 12 are such that when the two shells 11 and 12 are fitted together, as seen in FIG. 2, the outer edge 40 of flange 38 abuts the inner surface 23 of flange 19. Also, the inner edge 42 of ring 41 abuts surface 23 while the inner end 43 of hub 30 and the inner end 44 of sleeve 32 abut surface 16 and concentrically surround hole 43.

The axle 20 is generally a cylindrical member, the central periphery 50 of which is provided with an annular peripheral groove being about 0.080 to about 0.090 inch in an axial direction. The groove 50 is generated by the chord of a circle. Outwardly of groove 50 the axle is provided with axially disposed circumferentially spaced splines 51 which extend in diverging directions to terminate respectively, inwardly adjacent the ends of the axle 20. Thence, to the very ends, the axle 20 is of reduced diameter to function as guides for inserting the axle 20 in place.

The assembly of the Yo-Yo is quite simple. The two shells 11 and 12 are simply press fitted together, as depicted in FIG. 1. They may, if desired, be adhered together by adhesive or ultrasonic welding. Welding or adhesive bonding is usually not necessary. One end portion of axle 20 is swaged into one bore 33 of one segment 10. The bore 33 of the other segment 10 is then inserted over the other end portion of axle 20 and its segment 10 urged inwardly until the splines 51 are covered by the segments 10, as depicted in FIG. 2.

It will be observed that all of the various circular elements are concentric about a central transverse axis $\alpha$ and are thus concentric with each other. For example, axle 20, the opposed spaced parallel disc shaped walls 14, the wall 36, the circumferential arrangement of the protuberances 17, the sleeves, such as sleeve 32, the hubs, such as hub 30, the rings, such as rings 41 and 25 and the ring formed by the outer periphery of the segments 10 are all concentric.

When the axle 20 is inserted into segments 10 it passes first through holes 18 and thence into bore 33. The splines 51 thus dig into the inner periphery of metal sleeve 32, thereby firmly fixing the axle 20 in place. The axle 20 spaces the opposed parallel faces or surfaces 15 of walls 14 apart by a distance or gap of about 0.080 to about 0.090 inch.

A string 60 is received in the usual way around the central portion or groove 51 of axle 20. This string 60 extends outwardly of the Yo-Yo past the protuberances 17. Because of the opposed outwardly diverging conical surfaces 22, which diverge at about 8° from the planes of surfaces 15, the string 60 on the rotating Yo-Yo cannot readily engage the peripheries 24, unless there is a very substantial canting of the spinning Yo-Yo. With a gap between the parallel faces or surfaces 15 of about 0.09 inch and a diameter for periphery 20 of wall 14 of about 1.2 inch the angle $\beta$ (known as the curve angle relationship), subtended by a string 60 with respect to either faces 15, is about 4°, as it strikes the inner surface adjacent periphery 21. This permits a play of about 8° for the string 60. This is about three times the string play of a conventional Yo-Yo and reduces the likelihood of the Yo-Yo precessing. Hence, the Yo-Yo of the present invention is more readily used by a novice. This angle $\beta$ can vary from about 2° to about 6°.

The angle $\gamma$ i.e., the angle subtended between the surface 15 and the surface 22 is about 8° but can vary between about 6° and about 10°. The diverging surfaces 22 permit easy access for an intermediate portion of string 60 when performing tricks, such as "Man on the Flying Trapeze".

The overall diameter of the Yo-Yo is about 2 ½ inches with a ratio of the radius of the radial distance or width of flange 19 to wall 15 being preferably 1.15:1. However, this ratio may vary from about 0.8:1 to about 1.4:1. It is preferable, however that there be sufficient space between the faces 15 to receive the entire spring 60 wound around axle 20. This facilitates even distribution of the convolutions of the string 60 as it is wound up, while also providing a wide area for receipt of the string and a reduced moment arm, i.e., the distance from axle to periphery 21, for precussion.

The axle 20 can be quite small in diameter usually ⅛ inch reducing to a 1/16 inch at the groove 51. This is because the outer periphery of the aluminum or metal sleeves 32 provide sufficient area for contact with the segments 10. The reduced diameter groove 51, which is quite smooth, causes a minimum of friction on the string 60. This enhances the spinning time of the Yo-Yo.

The weight of the Yo-Yo at the peripheries of the segments 10 by flange 38, ring 25 and ring 23 provide a flywheel effect which enable a slow build-up of the rotational velocity but once built up, it will spin for a very long time.

The opposed rounded tipped protuberances 17 on surfaces 15 which are arranged in an area around axle 20, encompassing about one-fourth inch from axis $\alpha$ quite readily snare the loose strands of string 60 for wind up. This permits the small diameter smooth surface axle 20 to be used which otherwise might not grab the string 60 for wind up.

The almost uniform thickness of about 1/16 inch and the general overall thinness of shells 11 and 12 permit rapid cooling in the injection moulded shells 11 and 12. This speeds up production of these parts.

The straight, visually observable, abutment 70, between the peripheries of the two shells 11 and 12, enables one shell to be colored one color and the other, another color. This improves the appearance of the Yo-Yo.

The quite thick intermeshed composite flywheel created by rings 41 and 25 and flange 38, and the large diameter hub 30, provide a quite rugged construction which will be held together by friction alone, if necessary. It is, however, desirable to glue the abutting plastic together to enhance the overall strength. The groove defined by ring 41 and flange 38 forms a natural cup for the liquid glue.

The Yo-Yo of the present invention is quite useful for "loose string" tricks. A "loose string" trick is a manipulation requiring the Yo-Yo to spin at the end of the string for an extended period. "Walk The Dog", "Around the World", "Rock the Baby", are tricks which are facilitated by the present Yo-Yo. The Yo-Yo of the present construction will usually spin for about two and one half times longer than a conventional Yo-Yo.

What is claimed is:

1. A Yo-Yo comprising an axle and a pair of opposed complementary body segments spaced apart by said axle, each of said segments including a circular inner shell, a circular outer shell and means non-rotatably joining them together to define a hollow interior, said shells being integrally molded of plastic, said means comprising intermeshing concentric rings at the peripheries of said shells, one shell of each of said segments having a first side wall and, as its portion of said concentric rings, two spaced rings protruding from said first side wall, the other shell of said each of said segments having a second side wall spaced from said first side wall and, as its portion of said concentric rings, a ring protruding from said second side wall and snuggly received and sandwiched between said two spaced rings, said concentric rings of said segments respectively forming the radially outer peripheries of said segments and forming a thickness, radially of such segments, in excess of the thickness of each side wall.

2. The Yo-Yo of claim 1 wherein said shells are plastic and including a central hub between the central portions of said inner shell and said outer shell and a metal boss carried by said hub, an end portion of said axle projecting into said metal boss.

3. The Yo-Yo of claim 1 wherein the peripheral portion of said outer shell forms one of said rings, said inner shell and said outer shell being of approximately equal diameters, and wherein another of said rings is spaced inwardly from the periphery of said inner shell and projects axially outwardly from said inner shell radially inwardly of the peripheral portion of said outer shell.

4. The Yo-Yo of claim 3 wherein said shells are molded material and said rings include said third ring projecting inwardly from said outer shell inwardly adjacent said other of said outer shell rings, said inner shell ring being secured to said outer shell rings.

5. The Yo-Yo of claim 1 wherein the inner shells of said segments are in spaced opposed relationship to each other, the radially inner opposed surfaces of said inner shells being approximately parallel to each other and the opposed surfaces of said inner shells radially outwardly of said inner opposed surfaces, being conical and diverging from each other toward the peripheries of said inner shells.

6. The Yo-Yo of claim 1 including a string slideably received by its inner end on said axle and extending outwardly therefrom and wherein the inner surfaces of the inner shells are disposed in spaced opposed relationship to each other, and including a plurality of spaced protuberances circumferentially and radially disposed around said axle and protruding inwardly from said inner surfaces of said inner shells for engaging the string which extends from said axle.

7. The Yo-Yo of claim 6 wherein said protuberances are cone shaped with rounded ends.

8. The Yo-Yo of claim 1 wherein said inner and outer shells respectively have cross sections of approximately uniform thickness.

9. In a Yo-Yo having a pair of opposed complementary body segments spaced apart by an axle with each body segment including a pair of integrally molded plastic circular shells, the improvement comprising one of each pair of said circular shells having a pair of concentric rings adjacent the radially outer periphery thereof and the other of said shells having a ring fitted snugly between the pair of rings for non-rotatably joining together the shells of each segment and for weighting the segment periphery.

10. A Yo-Yo comprising an axle and a pair of opposed complementary body segments spaced apart by said axle, each of said segments including a circular inner plastic shell, a circular outer plastic shell, and means non-rotatably joining them together to define a hollow interior, said means comprising intermeshing concentric rings at the peripheries of said shells; one of said inner and outer shells further including an integral central hub between the central portions of said inner shell and said outer shell and a metal bushing non-rotatably mounted in said hub; an end portion of said axle projecting into each of said metal bushings and being non-rotatably joined thereto.

11. A Yo-Yo comprising an axle and a pair of opposed, spaced, complementary body segments mounted concentrically on opposite end portions of said axle, said axle being non-rotatable with respect to said body segments, each of said body segments including a circular inner shell and a circular outer shell joined together along their peripheral portions to define a closed hollow interior, said shells adjacent their outer peripheries, being provided with oppositely, sidewise extending rings which overlap each other, said shells being of approximately uniform thickness with respect to each other and said rings being of approximately uniform thickness with respect to both of said shells and each other, said shells being so dimensioned that a major portion of the weight of said shells is disposed in said rings so as to improve the spinning characteristics of said yo-yo, said shells including a central hub disposed concentrically within each segment and a sleeve surrounded by said central hub, said central hub projecting from the inner surface on one of said shells and said sleeve projecting from the inner surface of the other of said shells.

12. The Yo-Yo defined in claim 11 including a ring abutting the inner peripheral ring of each segment, said ring being secured to the inner surface of the shell containing the outermost ring.

* * * * *